US005391092A

United States Patent [19]

Sumida

[11] Patent Number: 5,391,092

[45] Date of Patent: Feb. 21, 1995

[54] CONNECTOR COVER AND METHOD FOR ASSEMBLING CONNECTOR COVER

[75] Inventor: Tatsuya Sumida, Yokkaichi, Japan

[73] Assignee: Sumitomo Wiring Systems, Ltd., Mie, Japan

[21] Appl. No.: 114,306

[22] Filed: Sep. 2, 1993

[30] Foreign Application Priority Data

Oct. 6, 1992 [JP] Japan ..... 4-075881[U]

[51] Int. Cl.[6] ..... H01R 13/58

[52] U.S. Cl. ..... 439/470

[58] Field of Search ..... 439/467, 470, 465, 471

[56] References Cited

U.S. PATENT DOCUMENTS 4,108,527 8/1978 Douty et al. ..... 439/465
4,169,648 10/1979 Moist, Jr. ..... 439/467
4,449,776 5/1984 Carmo et al. ..... 439/472
4,900,277 2/1990 Inaba et al. ..... 439/465
4,952,168 8/1990 Schieferly et al. ..... 439/467

FOREIGN PATENT DOCUMENTS 3108744 9/1982 Germany ..... 439/467

*Primary Examiner*—Gary F. Paumen
*Attorney, Agent, or Firm*—Oliff & Berridge

[57] ABSTRACT

A cover of an integrally molded construction includes a pair of split cover members that are formed by splitting a tubular member into halves, and are interconnected by a self-hinge portion. The two split cover members are turned about the self-hinge portion to abut against each other to form a cover body of a hollow tubular configuration that encloses wires of a connector. An elastically-deformable retaining portion is formed at a front end portion of each split cover member and is engaged with a retaining projection on a connector housing, thereby retaining the cover to the connector housing.

9 Claims, 4 Drawing Sheets

CONNECTOR COVER AND METHOD FOR ASSEMBLING CONNECTOR COVER

BACKGROUND OF THE INVENTION

This invention relates to a connector cover for mounting on a wire lead-out portion of a connector housing.

For connecting a terminal of a relay used in a vehicle, for example, to a relay circuit, it is a common practice to use a connector. In this case, the connector is required to be of a drip-proof construction if the relay is installed in an engine room, although such a construction is not necessary if the relay is installed in a compartment of the vehicle.

There has heretofore been provided such a drip-proof construction in which a grommet of rubber is fitted on a relay and a connector connected to this relay. In this construction, however,.the following procedure must be adopted when the connector is to be connected. Namely, before connecting the connector, the grommet is first fitted on the relay to be held in intimate contact therewith. Then, a skirt portion of the grommet is turned or folded back to expose a connector portion of the relay, and the connecter is inserted into and connected to this connector portion. Thereafter, the skirt portion of the grommet is returned to fit on the connector. Since the connector is thus connected by fitting and folding the grommet, this operation requires time and labor, which results in a drawback that the efficiency of the operation is very low.

There has been proposed a construction shown in FIG. 4 which is aimed at improving the .above construction. In this construction, a cover 2 is attached to a rear end portion of a connector housing 1 to cover a wire lead-out portion of the connector housing 1. The cover 2 is basically of a hollow tubular construction, and a wire introducing opening 4 for introducing electric wires 3, led out from the connector housing 1, from the side of the cover 2 is formed in one side surface of the cover 2. A closure tongue 5 for covering the wire introducing opening 4 in the cover 2 is formed on and extends from the connector housing 1. When the cover 2 is fitted in the connector housing 1 from the rear side of the connector housing, the closure tongue 5 is guided by a guide piece 6, and closes the wire introducing opening 4. Engagement projections 7 for maintaining the condition of attachment of the cover 2 to the connector housing 1 are formed on the connector housing 1. Lock pieces 8 for engaging respectively with these engagement projections are formed on the cover 2. Formed on and projected from the front side of the cover 2 are retaining projections 9 which serve to force terminals (not shown), provided within the connector housing 1, into respective proper mounting positions.

Where the relay is installed not in an engine room but in a vehicle compartment, the above connector does not need to be of a drip-proof construction, and the cover 2 does not need to be attached. However, in the above conventional cover-and-connector construction, the closure tongue 5 is projected from the rear end of the connector housing 1, and therefore when this connector housing 1 is used without the cover 2, the closure tongue 5 is obstructive, and limits the position of installation of the relay. Therefore, conventionally, two kinds of connector housings have been prepared depending on whether or not the cover 2 is attached. When the cover is to be attached, the connector housing 1 shown in FIG. 4 is fitted in a relay. When the cover is not to be attached, the type of connector housing without the closure tongue 5 is fitted in a relay. With this system, however, two kinds of connector housings are needed, which raises a problem that a stock control of parts is cumbersome.

SUMMARY OF THE INVENTION

The present invention has been made under the above circumstances, and an object of the invention is to provide a connector cover which enables connector housings of ordinary configurations to be used commonly regardless of whether or not the cover is attached.

According to the present invention, there is provided a connector cover for covering a wire lead-out portion of a connector housing, which comprises a cover body constituted by a pair of split cover members interconnected by a hinge portion, the split cover members being formed by longitudinally splitting a tubular member into halves; an engagement portion and a mating engagement portion which are provided respectively on the two split cover members, and are engageable with each other, the engagement portion and the mating engagement portion holding the two split cover members in an abutted condition to form the cover body of a hollow tubular configuration when the two split cover members are turned about the hinge portion to enclose wires led out from the connector housing; and a retaining portion engageable with a mating retaining portion, formed on the connector housing, to retain the cover body in such a manner that the cover body encloses the wire lead-out portion of the connector housing.

The cover body comprises the pair of split cover members interconnected by the hinge portion, and the split cover members are obtained by longitudinally splitting a tubular member into halves. Therefore, when the two split cover members are turned about the hinge portion to be abutted against each other to enclose the wires led out from the connector housing, with the engagement portion and the mating engagement portion engaged with each other, the cover body of a hollow tubular configuration enclosing the wires is constituted. Then, by engaging the retaining portion of the cover body with the mating retaining portion of the connector housing, the cover body can be attached to the connector housing.

In this construction, since the half split cover members are abutted together in such a manner as to enclose the wires, there is no need to provide a wire introducing opening for introducing the wires, and also a closure tongue for closing the wire introducing opening does not need to be provided on the connector housing.

As described above, it is not necessary to provide a closure tongue of a large size on the connector to which the cover of the present invention is to be attached, and this overcomes the problem that such a tongue is obstructive when the cover is not attached. Therefore, there is provided an excellent advantage in practical use that regardless of whether or not the cover is attached, the connector housing can be used in both cases.

DETAILED DESCRIPTION OF THE PREFERRED EMBODIMENT

Figure 1:
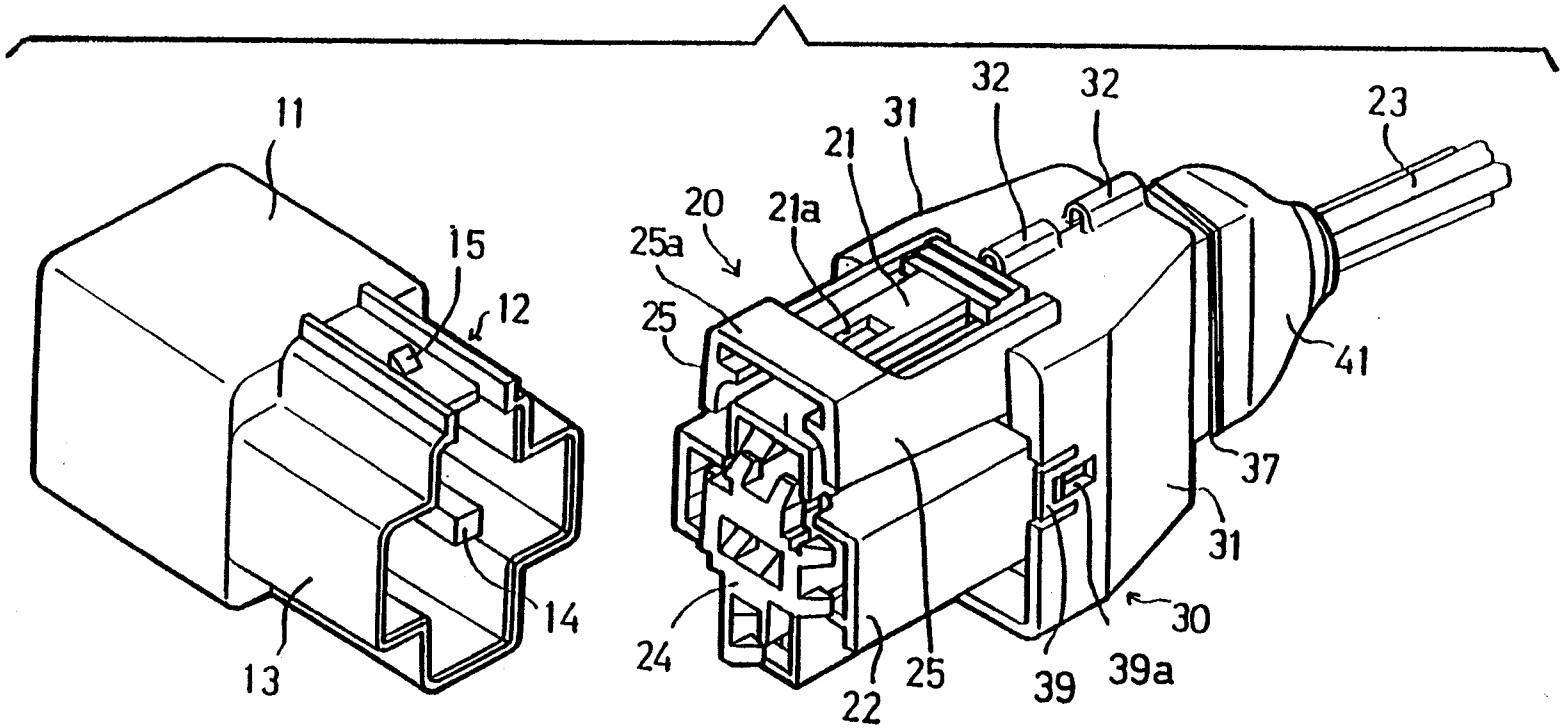
FIG. 1 is a perspective view showing the whole of a preferred embodiment of the present invention.
Figure 2:
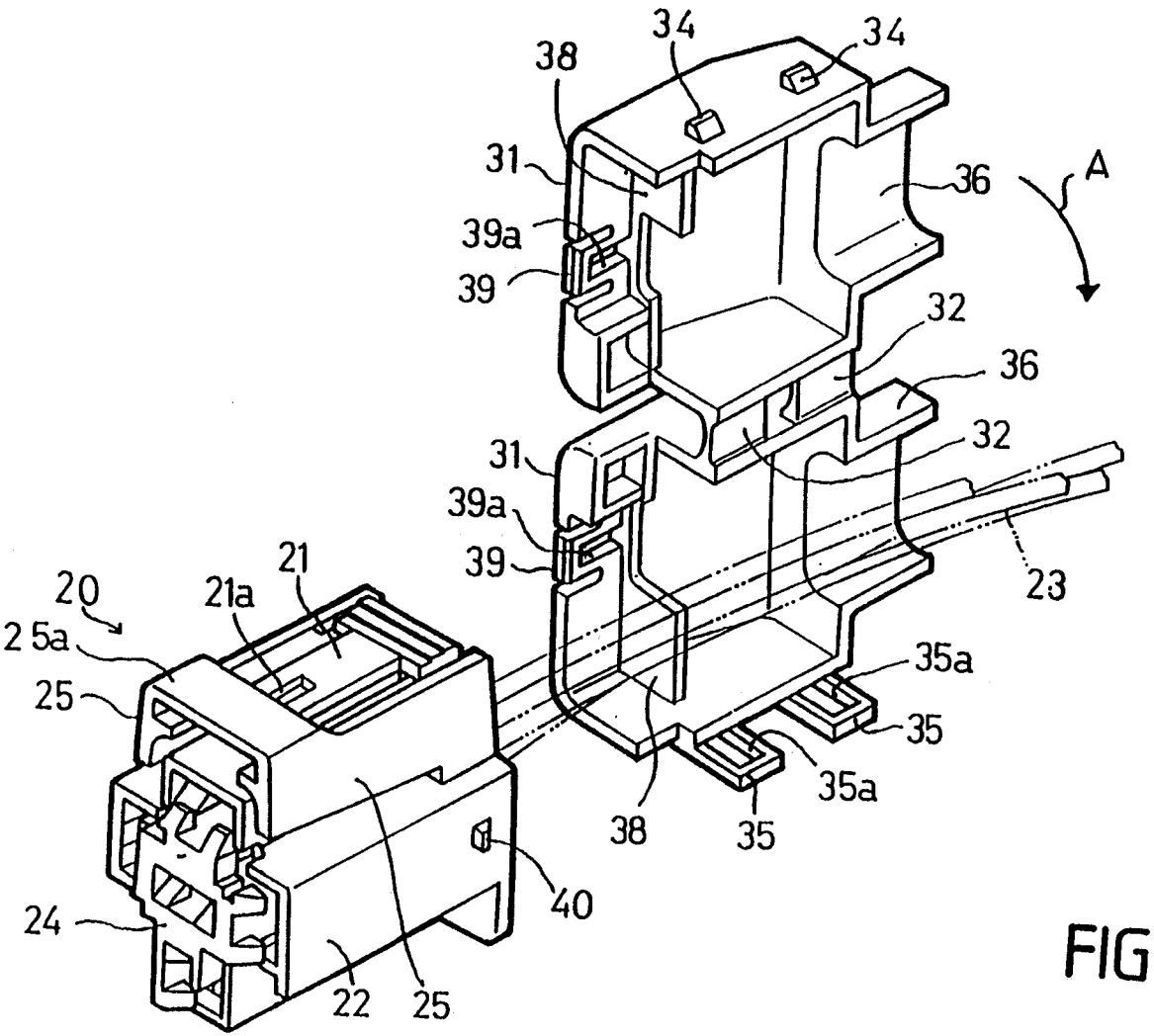
FIG. 2 is an exploded perspective view showing a stage before a cover body is formed.
Figure 3:
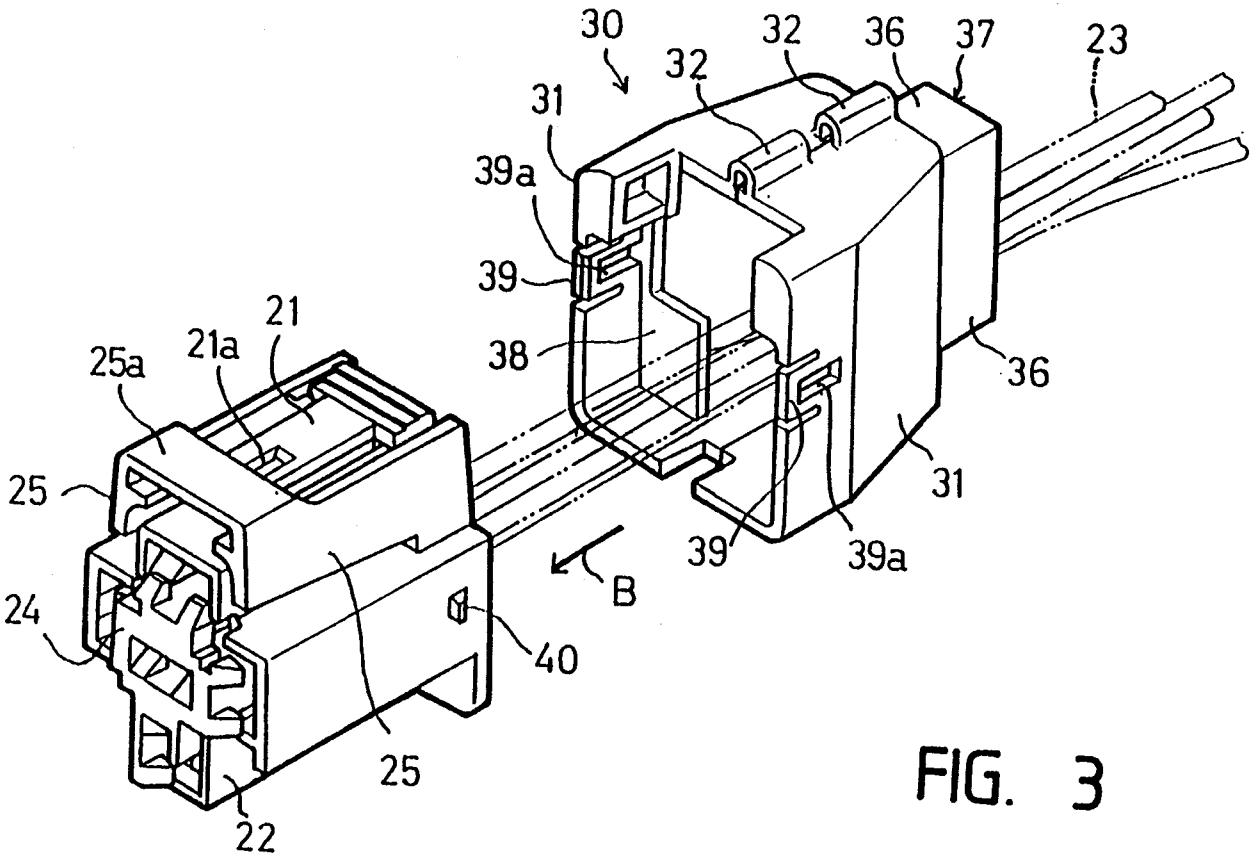
FIG. 3 is an exploded perspective view showing a stage after the cover body is formed.

One preferred embodiment of the present invention will now be described with reference to FIGS. 1 to 3.

A connector cover in this embodiment is adapted to be attached to a connector housing connected to a relay used in a vehicle. The manner of attachment of the cover is shown, together with the relay and the connector housing, in FIG. 1.

Reference is first made to the relay and its connector. A relay body 11 has a generally rectangular parallelepipedic shape as a whole, and a connector 12 is formed integrally on one face of the relay body. The connector 12 includes, for example, four male terminals (not shown) electrically connected to relay contacts (not shown) provided within the relay body 11, and a tubular hood portion 13 of a cross-shaped cross-section which covers these male terminals. A projection 14 for preventing an improper connection is formed within the hood portion 13 at a generally central portion thereof. Provided on an upper portion (in the drawings) of a peripheral surface of the hood portion 13 is a lock projection 15 which engages a lock arm 21 formed on a connector 20 (later described).

The connector 20 for connection to the above relay connector 12 also includes a tubular connector housing 22 of a cross-shaped cross-section. Female terminals (not shown) connected respectively to electric wires 23 are provided within the connector housing 22. When a retainer 24 is inserted into and attached to the connector housing 22 from the front side of this connector housing, it is confirmed that the female terminals are in a completely-installed condition. The connector housing 22 is of such a shape and size that it can be inserted into the hood portion 13 of the relay connector 12. When the connector housing 22 is inserted deep into the hood portion 13, the female terminals are connected respectively to the male terminals of the relay connector.

The lock arm 21 is molded or formed integrally on the outer surface of the connector housing 22 of the connector 20 through a support leg (not shown) in such a manner that the lock arm 21 is elastically deformable. The lock projection 15 formed on the hood portion 13 of the relay connector 12 is engageable in an engagement hole 21a formed in the lock arm 21. A pair of protective walls 25 are formed respectively on opposite (right and left) sides of the lock arm 21 in spaced relation to the lock arm 21. The front end portions of the protective walls 25 are interconnected by a bridge portion **25*a*. With this arrangement, the protective walls 25 cover the distal end portion of the lock arm 21 from the opposite sides and the upper side in a U-shaped configuration, thereby protecting the distal end portion of the lock arm 21** and also preventing the wires from being engaged with this distal end portion.

A connector cover 30 is releasably attached to the rear end portion of the connector 20. As shown in FIGS. 2 and 3, the cover 30 comprises a pair of half split cover members 31 and 31 which are obtained by longitudinally splitting a tubular member into halves. The cover is of such an integrally molded construction that the split cover members 31 and 31 are interconnected by self-hinge portions 32 serving as a hinge portion. When the two split cover members 31 are turned about the self-hinge portions 32 to be mated together, the two cover members 31 constitute a cover body 33 of a hollow tubular configuration (see FIG. 3) to enclose the wires of the connector 20. Engagement projections 34 serving as engagement portions are formed on an end portion of the outer peripheral surface of one split cover member 31, and engagement pieces 35 each having an engagement hole **35*a* (which serves as a mating engagement portion) are formed on an end portion of the outer peripheral surface of the other split cover member 31. The engagement projections 34 are engaged respectively in the engagement holes 35*a* to hold the two split cover members 31 in an abutted condition. A half split portion 36 which is a half of a square tubular portion is provided at the rear end of each of the split cover members 31, and when the split cover members 31 are abutted together, the two half split portions 36 are joined together to constitute a tape-winding tubular portion 37. A stopper wall 38 is formed integrally on the inner surface of each split cover member 31** adjacent to the front end of the split cover member.

An elastically-deformable retaining piece 39 is formed on the front end of each split cover member 31, and a retaining hole **39*a* serving as a retaining portion is formed in the retaining piece 39. Retaining projections 40 (only one of which is shown) which serve as mating retaining portions are formed respectively on the opposite (right and left) sides of the connector housing 22 of the connector 20** adjacent to the rear end thereof.

In this embodiment, the cover 30 is attached to the connector 20 in the following manner. The wires 23 led out from the connector 20 are received in one split cover member 31, as shown in FIG. 2, and in this condition, the other split cover member 31 is turned about the self-hinge portions 32 in a direction of arrow A. As a result, the two split cover members 31 are abutted against each other to form the cover body 33 of a tubular configuration, with the engagement projections 34 engaged respectively in the engagement holes **35*a* in the engagement pieces 35. The wires 23 led out from the connector 20 are passed through the interior of the cover body 33. Then, when the cover body 33 is held with the fingers, and is moved in a direction of arrow B, the front end portion of the cover body 33 is fitted on the rear end portion of the connector housing 22, and the rear end of the connector housing 22 is abutted against the stopper walls 38 of the cover body 33. At this stage, the retaining projections 40 of the connector housing 22 are engaged respectively in the retaining holes 39*a* of the retaining pieces 39 of the cover body 33, so that the cover body 33 is fixed to the connector housing 22. Thereafter, if necessary, a tape 41 is wound on the tape-winding portion 37, provided at the rear end of the cover body 33, and the wires 23 extending from the tape-winding portion 37**. This further enhances a drip-proof performance (see FIG. 1).

Figure 4:
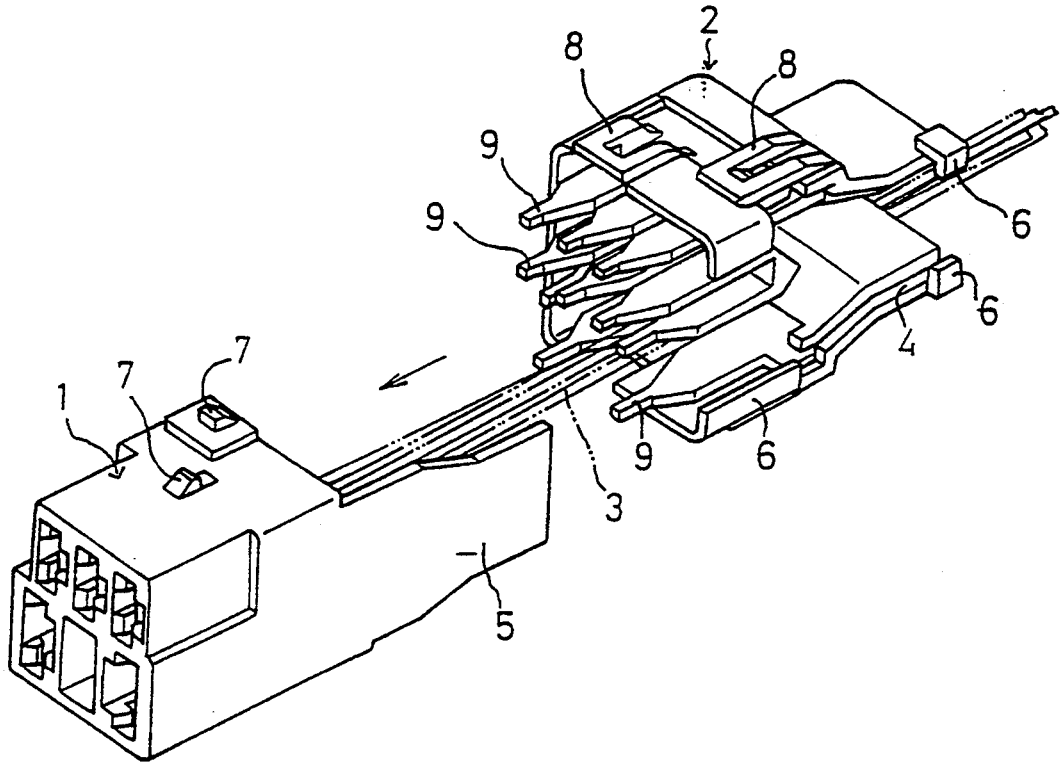
FIG. 4 (PRIOR ART)
FIG. 4 is a perspective view of the conventional connector cover.

If the drip-proof function is not necessary as when the relay body 11 is installed in a vehicle compartment, the cover 30 does not need to be attached to the connector housing 22. The connector 20 without the cover 30 is not provided with the closure tongue 5 used in the conventional connector 1 of FIG. 4, and therefore the connector 20 can be of a compact construction, and will not impose any limitation on the position of installation of the relay as in ordinary connectors.

In the above embodiment, although the invention is applied to the relay connector, the invention is not limited to it, and can be widely applied to ordinary-type connectors for connection to wires.

In the above embodiment, although the tape 41 is wound on the cover 30 and the wires 23 to enhance the drip-proof performance, this is not always necessary, and depending on the position of installation of the connector, a sufficient drip-proof performance may be obtained merely by attaching the cover 30.

Furthermore, the invention is not to be limited to the above embodiment, and various modifications can be made without departing from the scope of the invention.

What is claimed is:

1. A connector cover for covering a wire lead-out portion of a connector housing, comprising:

a pair of cover members that are obtained by longitudinally splitting a tubular member into halves, said cover members integrally molded to be interconnected by a hinge portion, said pair of cover members forms a cover body of a hollow tubular configuration to enclose wires of the connector housing by engaging with each other;

engagement projection portions formed on an end portion of an outer peripheral surface of one cover member;

engagement pieces each having an engagement hole formed on an end portion of an outer peripheral surface of the other cover member, said engagement projection portions engageable respectively in said engagement holes to hold said pair of cover members in a closed condition; and elastically-deformable retaining pieces connected to respective side walls of said cover members and extending toward the front end of each cover member, each retaining piece having a retaining hole to be engaged with respective retaining projections formed on respective side surfaces of the connector housing as said cover is slid axially over said connector housing.

2. The connector cover as claimed in claim 1, wherein each of said cover members comprises:

a half of a square tubular portion provided at a rear end of each of the cover members, and when the cover members are abutted together in said closed condition, the two half square tubular portions are joined together to form a tape-winding tubular portion.

3. The connector cover as claimed in claim 1, wherein each of said cover members comprises:

a stopper wall formed integrally on an inner surface of each cover member adjacent to a front end of each cover member.

4. A connector cover for covering a wire lead-out portion of a connector housing, comprising:

a cover body having first and second cover members that are connected by a flexible hinge, said first cover member including engagement projection portions positioned on an end portion of an outer peripheral surface of the first cover member, said second cover member including engagement pieces each having an engagement hole formed on an end portion of an outer peripheral surface of the second cover member, said engagement holes being securable over said engagement projection portions to hold said cover members in a closed condition, each of said first and second cover members including a retaining piece formed as a part of a side wall thereof and extending toward a front end portion of the respective first cover member and second cover member to allow said cover to be slid in said closed condition axially over said connector housing and then secured thereto by said retaining pieces.

5. The connector cover as claimed in claim 4, wherein each of said first and second cover members comprises a half portion of a tape-winding tubular portion that is formed when the first and second cover members are joined together.

6. A connector cover for covering a wire of a connector housing comprising:

a pair of cover members that are interconnected by a hinge portion, said pair of cover members including respective engagement projection portions and engagement pieces that cooperate when the cover members are joined together; and a retaining piece formed as a part of a respective side wall of each cover member that extends toward the front end of each cover member and includes a retaining hole that is engageable with respective retaining projections formed on respective side surfaces of the connector housing; and a half square tubular portion connected to a rear end of each of the cover members.

7. A method of assembling a cover portion to a connector, said cover including a pair of cover members interconnected by a hinge and including respective engagement portions and engagement pieces that are cooperable to releasably connect the cover members, and retaining members formed on respective side walls of each of the pair of cover members that are engageable with corresponding retaining projections formed on respective side surfaces of the connector housing, the method comprising the steps of:

placing a wire lead-out portion of a connector housing within one of the pair of cover members;

pivoting one of said pair of cover members with respect to the other of said pair of cover members about said hinge;

engaging said engagement portions of one of said cover members with engagement pieces of the other of said pair of cover members for enclosing said wire lead-out portion and forming an assembled connector cover; and connecting the assembled connector cover to the connector housing.

8. The method of claim 7, wherein the step of connecting includes sliding the assembled connector cover along an axial direction defined by said wire lead-out portion and engaging said retaining members with said retaining projections.

9. The method of claim 7, further comprising the step of providing each of said cover members with a half square tubular portion and said engaging step includes engaging the respective half square tubular portions of said pair of cover members to form a tape winding tubular portion.

* * * * *